US006371205B1

(12) United States Patent
Langan et al.

(10) Patent No.: US 6,371,205 B1
(45) Date of Patent: Apr. 16, 2002

(54) BORE HOLE GROUTING APPARATUS AND METHOD

(75) Inventors: Patrick Joseph Langan, Winnemucca, NV (US); Robert E. Able, Bozeman, MT (US)

(73) Assignee: Boart Longyear International Holdings, Inc., Salt Lake City, UT (US)

( * ) Notice: Subject to any disclaimer, the term of this patent is extended or adjusted under 35 U.S.C. 154(b) by 0 days.

(21) Appl. No.: 09/518,050

(22) Filed: Mar. 2, 2000

(51) Int. Cl.[7] ..... E21B 33/00
(52) U.S. Cl. ..... 166/285; 166/177.4; 175/72
(58) Field of Search ..... 175/72; 166/285, 166/177.4

(56) References Cited

U.S. PATENT DOCUMENTS

| | | | | |
|---|---|---|---|---|
| 3,027,943 A | | 4/1962 | Reistle, Jr. | |
| 3,097,698 A | | 7/1963 | Corley, Jr. et al. | |
| 3,175,628 A | | 3/1965 | Dellinger | |
| 3,448,800 A | | 6/1969 | Parker et al. | |
| 4,378,050 A | * | 3/1983 | Tatevosian et al. | 172/72 |
| 4,438,813 A | | 3/1984 | Nikolaev et al. | |

FOREIGN PATENT DOCUMENTS

| | | | |
|---|---|---|---|
| AU | B-97016/98 | 4/1998 | |
| SU | 1435760 | * 11/1988 | 175/72 |

* cited by examiner

*Primary Examiner*—William Neuder
(74) *Attorney, Agent, or Firm*—Clayton R. Johnson

(57) ABSTRACT

The grouting apparatus includes a tubular body, an outer end closure removably mounted to the outer end of the tubular body and a nozzle mounted to the inner end of the tubular body to form a container for grouting material. The tubular body has a landing shoulder seatable on a drill string landing shoulder. The closure includes an overshot coupling member and a head having an inlet passage opening to the tubular body. A piston and a sleeve are axially movable in the tubular body to force the grouting material out of the container, the sleeve blocking flow through the piston as the piston moves inwardly, but after abutting against the nozzle, opening a bypass channel from outwardly of the piston, through the piston and to the nozzle tube. Upon the sleeve moving inwardly relative to the piston, the fluid outwardly of the container may be pumped through the container to mix with the grouting material that was dispensed into the container prior to the container being inserted into the drill string.

11 Claims, 2 Drawing Sheets

BORE HOLE GROUTING APPARATUS AND METHOD

BACKGROUND OF THE INVENTION

This invention relates to grouting apparatus and a method for grouting bore holes.

During drilling, for example during exploratory core drilling, caving of earth formations can cause high torque and drill string vibrations problems which result in slower progress in completing the drilling operation. Also, during drilling operations, at times undesirable leakage problems may be encountered.

U.S. Pat. No. 3,175,628 to Dellinger is directed to discharging drilling additives in a bore hole and in particular, flocculating agents. The apparatus includes a sub connected in a drill string above the bit and has a shoulder against which a wire line container may be lowered to abut. A piston in the container is forced under fluid pressure to force the additive out through the orifice at the container lower end. A ring is biased by a spring to a sealing position to block the orifice until the container is adjacent to the above mentioned shoulder.

U.S. Pat. No. 3,027,943 to Reistle, Jr discloses an assembly lowerable by a wire line to have its shoulder seat on the shoulder of a sleeve and to extend though the sleeve. The assembly has a chamber in which a piston, in moving toward the bit end, forces the liquid treating reagent out of the chamber. Fluid for forcing the piston to move in the above manner may be introduced through the outer end of the assembly, for example see FIG. 3. This patent also discloses a packing feature.

U.S. Pat. No. 3,448,800 to Parker et al discloses positioning a plug for separating two fluids that are to be sequentially ejected into the bottom of a bore hole for forming a composition to inhibit lost circulation.

U.S. Pat. No. 3,097,698 to Corley, Jr. et al discloses a wire line cementing tool wherein there is provided a collar stop which apparently limits the inward movement of the tool in the drill string. Ports are provided in the cap member (overshot coupling member) through which hydraulic pressurized fluid can be exerted on the cement in the tool to force the fluid cement out of the tool.

In order to make improvements in grouting apparatus and a grouting method utilized in bore holes, this invention has been made.

SUMMARY OF THE INVENTION

A grouting assembly having grouting material therein is movable in a drill string to the inner end portion thereof to seat on the drill string landing shoulder and have the assembly nozzle extend inwardly of the drill bit. The assembly has an outer end closure that has an inlet port and an overshot coupling portion adapted to be engaged by a conventional wire line overshot assembly for being lowered or retracted in a drill string. The outer end closure is removably connected to a tubular body while the inner end of the tubular body is removably connected to a discharge nozzle.

The outer end closure, the tubular body and nozzle cooperatively provide a container for having grouting material dispensed thereinto. A piston is provided in the tubular body and it is extended into a sleeve which blocks a piston inlet port as the piston and sleeve are forced inwardly in the tubular body by fluid under pressure. Upon the piston moving to the inner end of the tubular body, a fluid channel is opened to permit fluid to flow inwardly through the outer end closure inlet and through the piston to be discharged through the nozzle. As a result, after the contents of the container has been discharged, an appropriate fluid under pressure can enter into and flow through the container to react with the contents of the container that were forced out by the piston moving inwardly and then harden.

One of the objects of the invention is to provide new and novel means movable in a drill string for containing a grouting material and discharging said material adjacent to the drill string bit end and permitting the flow of a fluid to mix with the discharged grouting material. Another object of this invention is to provide a grouting assembly having new and novel means for containing grouting material and once the material is discharged at the bit end of the drill string, open a fluid channel to allow fluid from outwardly of the assembly flowing through the assembly to mix with the discharged grouting material.

A different object of the invention is to provide in a retractable grouting assembly that is seatable on a drill string landing shoulder, new and novel means axially movable inwardly under fluid (hydraulic) pressure for forcing grouting material out of the assembly chamber and after the grouting material is forced out of the assembly chamber, allow fluid from exterior of the chamber to flow through the chamber to mix with the grouting material. Still another object of the invention is to provide new and novel means movable axially inwardly in a drill string and retractable through a drill string for facilitating sequentially applying two compositions of a binary grouting system in a bore hole.

For purposes of facilitating the description of the invention, the term "inner" refers to that portion of the drill string, or of the assembly, or an element of the assembly being described when, in its position "for use" in, or on, the drill string is located closer to the drill bit on the drill string (or bottom of the hole being drilled) than any other portion of the apparatus being described, except where the term clearly refers to a transverse circumferential, direction, or diameter of the drill string or other apparatus being described. The term "outer" refers to that portion of the drill string, or of the assembly, or an element of the assembly being described when, in its position "for use" in, or on, the drill string is located axially more remote from the drill bit on the drill string (or bottom of the hole being drilled) than any other portion of the apparatus being described, except where the term clearly refers to a transverse circumferential, direction, or diameter of the drill string or other apparatus being described.

DETAILED DESCRIPTION OF THE INVENTION

Figure 1A:
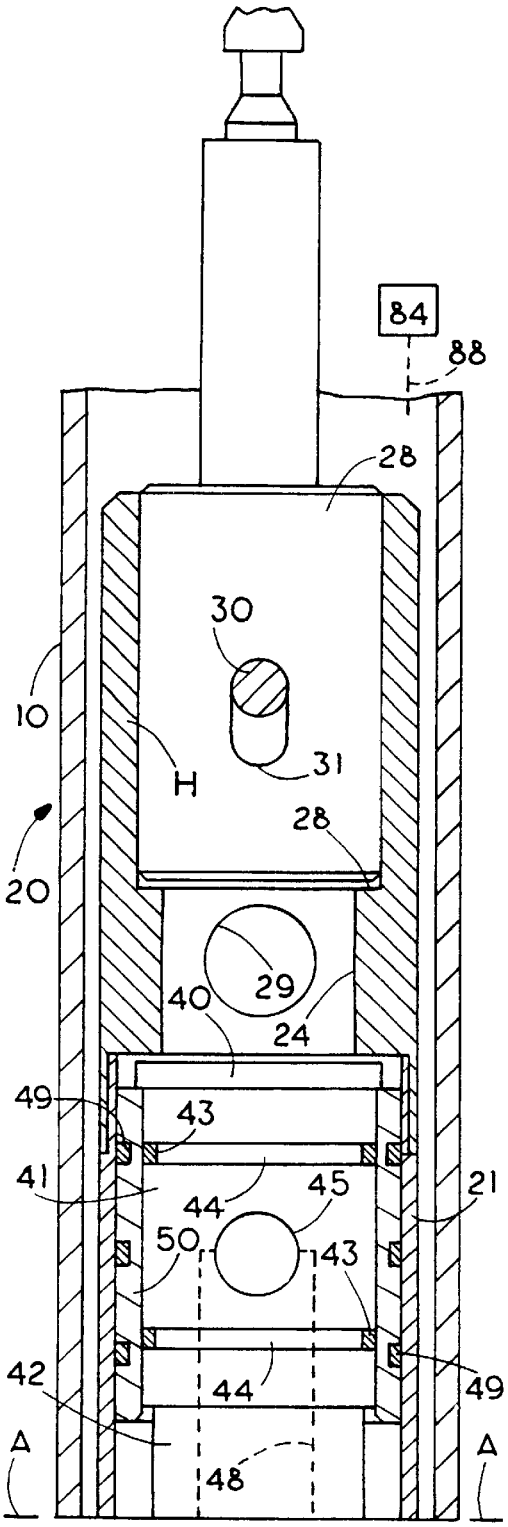
FIGS. 1A and 1B, when arranged one above the other with their axial center axes C—C aligned and lines A—A and B—B of FIGS. 1A and 1B aligned, form a composite longitudinal section through the grouting apparatus of the invention with axial intermediate parts broken away, said view showing the grouting apparatus just as it has seated on the drill string landing shoulder and prior to the piston moving inwardly in the container.
Figure 2A:
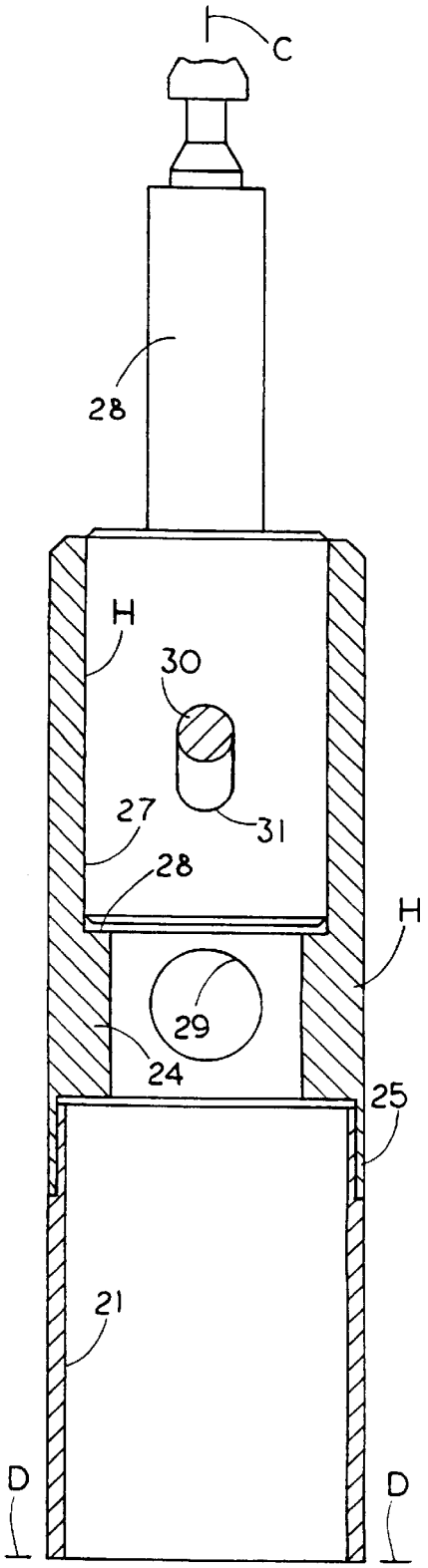
FIGS. 2A and 2B, when arranged one above the other with their axial center lines C—C aligned and lines DD and EE of FIGS. 2A and 2B aligned, form a composite longitudinal section through the grouting apparatus of the invention with axial intermediate parts broken away, said view showing the grouting apparatus after the piston has been forced to moved axially inwardly to expel the contents of the container.
Figure 1B:
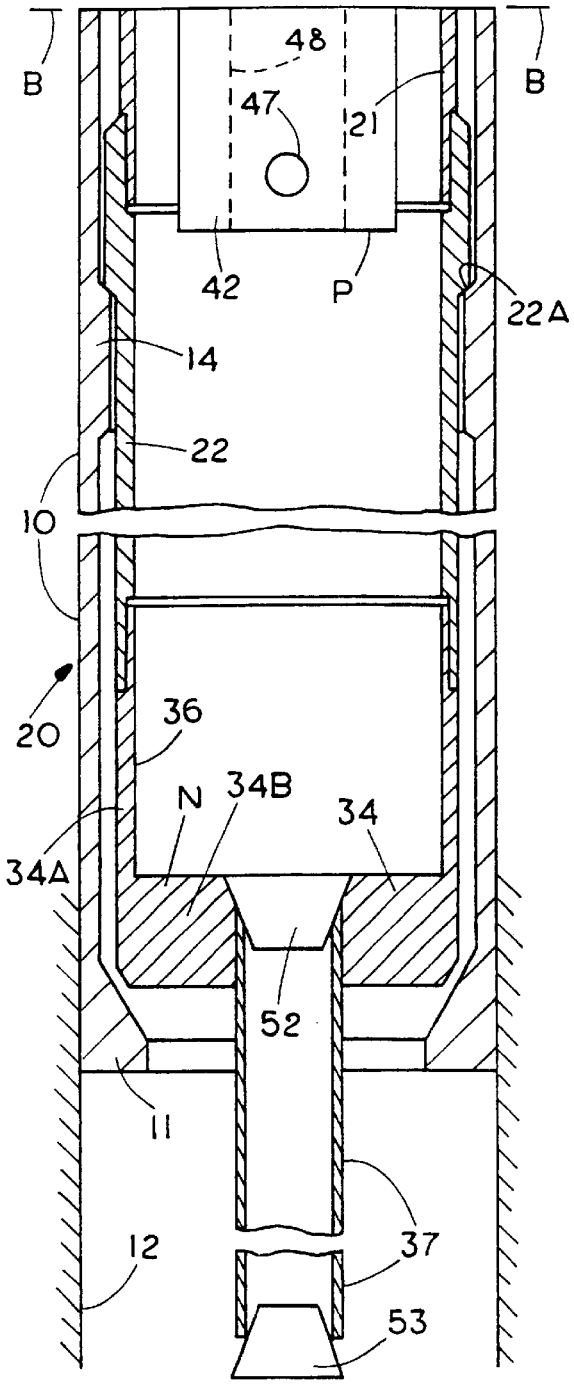
Figure 2B:
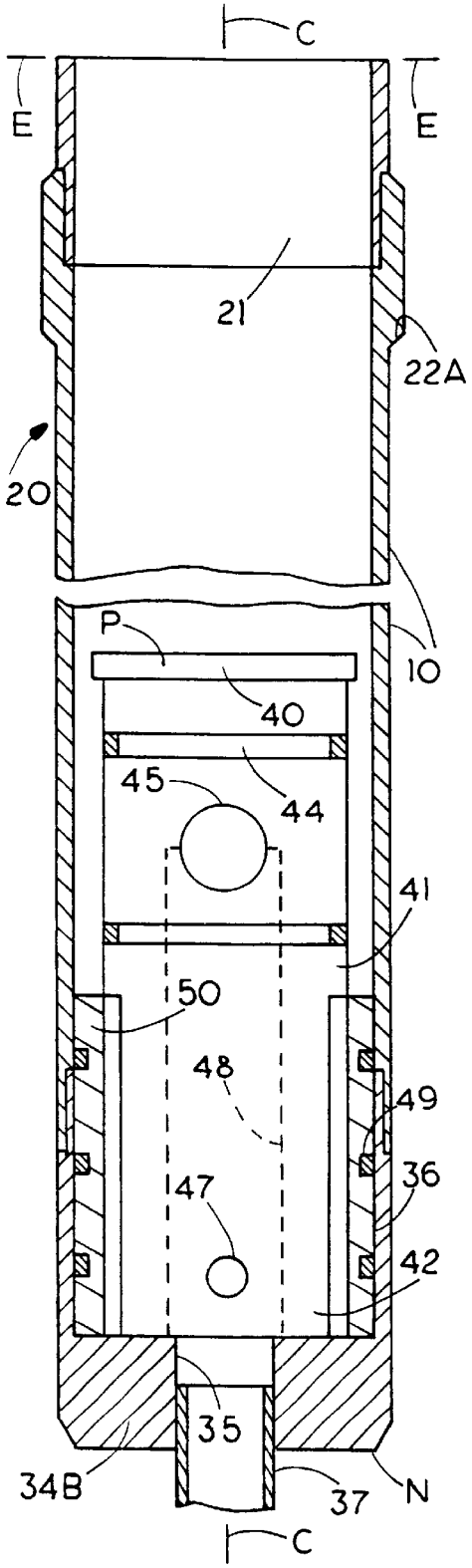

Referring now in particular to FIGS. 1A and 1B, there is illustrated a hollow drill string 10 which is made up of a series of interconnected hollow drill rods (tubes). The drill string 10 is in a downwardly extending bore hole 12 drilled in rock or other types of earth formations by means of an annular core bit 11. The drill string includes a landing shoulder 14 adjacent to and axially outwardly of the core bit as is conventional. Pump apparatus located at the drilling surface and indicated by block 84 pumps fluid under pressure through line 88 into the outer end of the drill string 10 in a conventional manner.

The grouting apparatus of this invention, generally designated 20, includes an outer end closure H, 28; a tubular body 21, 22; and a nozzle N that cooperatively provide a container for grouting material. The tubular body may be made up of a tubular extension 21 that is threadedly connected to the outer end of the inner tube 22. Either the outer end of the inner tube has an enlarged outer diameter portion forming a landing shoulder 22A, or in the alternative, a landing ring (not shown) may be mounted to the outer end portion of the inner tube to seat on the drill string landing shoulder to substantially restrict or block axial inward fluid flow therebetween when the grouting assembly landing shoulder 22A is seated on the drill string landing shoulder.

The outer end closure includes a tubular grout head H threadedly connected to the outer end of the tubular extension, the grout head having an axially reduced diameter bore portion 24 opening to its axial inner threaded portion which is threaded to the tubular extension at 25 and an axial outer bore portion 27 opening to its reduced bore portion to form a shoulder 28 inwardly of the overshot coupling member 28 which is part of the outer end closure. Diametrically opposite, transverse inlet bores 29 open to bore portion 24 and the outer peripheral surface of the head.

The overshot coupling member 28 is of a construction that is adapted for being retracted by a conventional overshot assembly (not shown). A pin 30 extends through a slot 31 in the overshot coupling member to mount the overshot coupling member to the tubular extension for limited axial movement.

The axial outer part 34A of the main body 34 of the nozzle N has a maximum diameter bore portion 36 that is threadedly connected to the inner end of the inner tube while the axial inner part 34B has a reduced diameter, transversely centered, axial bore portion (outlet) 35 which opens to bore portion 36. The inner part of the bore portion 35 is threaded to have the outer end of the nozzle tube 37 coupled thereto. Preferably, the extension tube, the inner tube and the part 34A of the main body are of the same or substantially the same inner diameters axially from the main body part 34B to the opening of the head bore portion 24 to the threaded bore portion 25, the interior of which forms a grouting assembly chamber for containing grouting material.

Mounted in the container for movement the axial length of the container chamber is an axially elongated piston P that has a diametrically enlarged, axial outer end portion 40, an axial intermediate, intermediate diameter portion 41 and an axial inner, reduced diameter portion 42. The piston outer end portion 40 is of a smaller diameter than the inner diameter of the tubular body to provide an annular clearance space. The intermediate portion 41 has two axially spaced, transverse outer annular grooves 44 which mount O-rings 43. A transverse bore 45 extends diametrically through the intermediate portion to open through the piston outer peripheral surface axially intermediate the grooves 44. Second transverse bores 47 opens diametrically through the piston reduced diameter portion 42 adjacent to the axial inner end thereof. A transversely centered, axial bore 48 opens through the inner end of the piston and to the transverse bores 45, 47 to form a fluid bypass channel, the axial outer end of the bore 48 terminating inwardly of the piston enlarged diametric portion 40.

Also mounted in the container for axial movement therein is an axially elongated sleeve (annular member) 50, the sleeve being of an inner diameter to form a close axial sliding fit with the axial intermediate portion 41 of the piston, but of a smaller inner diameter than the diameter of the piston enlarged axial outer portion 40. The sleeve is of an outer diameter to form an axial sliding fit with the inner peripheral wall of the tubular body and nozzle portion 34A, the sleeve having a plurality of annular grooves in which O-rings 49 are mounted to form a sealing fit between the sleeve and the tubular member inner peripheral wall.

Advantageously, the sleeve is of an axial length that is approximately the same as the axial length of the reduced diameter portion 42 of the piston. When the piston axial outer end portion abuts against head H at the opening of bore portion 24 to the tubular extension, and the axial outer annular edge of the sleeve abuts against the inner annular transverse surface of the piston portion 40, the sleeve extends axially adjacent to the juncture of the piston intermediate section 47 to the reduced diameter portion. That is, the axial length of the sleeve is the same or slightly greater than the axial length of the piston intermediate section 41. When the sleeve abuts against the piston outer end portion, the O-rings 43 form a fluid seal between the sleeve inner peripheral wall and the piston intermediate portion.

In using the grouting assembly, a rubber stopper 52 is positioned in bore 35 to block flow of flowable material in the tubular body inwardly into the nozzle tube. A second stopper 53 is positioned in the inner end of the nozzle tube to block the flow of material from exterior of the assembly into the nozzle tube during the movement of the grouting assembly inwardly to seat on the drill string landing shoulder. The stoppers are of a resilience that the stopper 52 is forced through the nozzle tube and stopper 53 out of the tube when the assembly landing shoulder abuts against the drill string landing shoulder and fluid under pressure is pumped into the drill string as set forth below.

With the assembly chamber cleaned and dried, the head H demounted from the extension tube and the piston and sleeve removed from the container, the desired charge of grouting material (grout resin and activator) is dispensed into the tubular body. It is noted that the tubular extension may be of varying lengths, the length depending upon the volume of charge to be contained in the grouting assembly chamber. Then the piston and sleeve are placed in the outer end of the tubular body while ensuring the sleeve blocks fluid flow axially outwardly through the piston bore 48 and exiting through piston bore 45 and from bore portion 24 inwardly to bore 45. Next, the outer end closure is mounted to the tubular body to prevent fluid flow between the head bores 29 and axially inwardly of the sleeve outer transverse surface. The grouting material in the tubular member prevents the piston and sleeve moving inwardly in the tubular body at this time.

With the core bit being moved axially outwardly of bore hole inner end and, depending upon the fluid level in the drill string, the grouting assembly is lowered in the drill string by an overshot assembly or is allowed to free fall under gravity to adjacent to the bit end of drill string. The drill string may be rotated at this time. Upon the grouting assembly shoulder landing on the drill string landing shoulder, the nozzle tube extends inwardly through the drill bit and axial inward fluid flow is blocked radially between the grouting assembly and the inner periphery wall of the drill string. As a result, inward fluid pressure of the fluid being pumped into the drill string builds up and is exerted radially inwardly through the bores 29 and thence axially inwardly through bore portion 24 to be applied against the outer transverse surface of the piston to move the piston and sleeve inwardly in the tubular body.

The inward movement of the piston acts through the charge in the container to, upon the hydraulic pressure inwardly of the piston exceeding at least a preselected level, force the stopper 52 inwardly through and out of the nozzle tube upon the hydraulic pressure exceeds at least a preselected level together with forcing the stopper 52 out of the nozzle tube. The hydraulic pressure required to move the stopper through the bore 35 is substantially higher than that while the grouting assembly is being pumped into the drill string as the grouting assembly is moving toward the drill string landing shoulder. Upon the stoppers being forced away from the discharge end of the nozzle tube, grouting material is discharged into the bore hole inwardly of the drill bit.

As the piston moves inwardly, it forces the sleeve to move inwardly, the area of the transverse outer surface of the piston being sufficiently greater than that portion of the transverse outer annular end surface of the sleeve subjected to the inward fluid pressure whereby the sleeve remains in a position relative to the piston to retain the bore 45 in a fluid bypass blocked condition.

Upon the piston moving inwardly to abut against nozzle main body portion 34B, the piston can not move further inwardly relative to the tubular body; however, since inward fluid pressure is still being exerted against the sleeve, the sleeve is moved inwardly relative to the tubular body and the piston until the sleeve abuts against the nozzle body part 34B. As the sleeve moves inwardly relative to the piston, fluid (grouting material) inwardly of the sleeve and radially between the piston and the inner peripheral wall of the tubular body and the nozzle portion 34A is forced through the bores 47 and into bore 48 to be discharged through the nozzle tube. It is noted that the annular clearance between the piston reduced diameter portion and the sleeve is of a relatively small transverse area, for example, the difference of the diameters of the reduced diameter portion and the inner diameter of the sleeve advantageously may be less than the difference of diameters between the inner peripheral wall and nongroved outer peripheral wall of the sleeve.

As the sleeve moves inwardly of at least part of the bores 45, nearly all of the grouting material that was in the container has been discharged through the nozzle tube, and the fluid that is being pumped into the drill string acting against the outer transverse surfaces of the piston and sleeve, flows through bores 45 and to piston bore 48, and the grouting material in the annular clearance space between the sleeve and piston reduced diameter portion flows through bores 47 to piston bore 48 and thence to the bore 35 and inwardly through the nozzle tube. The fluid that is pumped to hydraulically force the piston inwardly in the container flows radially inwardly through the bores 45 and the nozzle tube to mix with the grouting material that was forced out of the grouting assembly and forces the mixture into earth formation that is being grouted.

The grouting material dispensed into the grouting assembly chamber may be of conventional type or formulation that may or not harden to inhibit the caving and/or lost circulation problem without reacting with the drilling fluid that forces the piston and sleeve inwardly; or, of a conventional type that fills the pores or cracks through which drilling fluid is lost and/or inhibit caving and reacts (hardens) with the appropriate fluid contacting the grouting material without being mixed with an additional formulation. During the reaction of the last mentioned type with the drilling fluid, the grouting material cures and expands.

The last mentioned type of grouting material may be a component of a binary formulation, for example a resin activator mix dispensed into the assembly chamber and after the resin activator mix is discharged from the chamber and into the bore hole, the second component of binary formulation (catalyst), the fluid that exerts fluid pressure to move the piston inwardly is pumped through the grouting assembly chamber, including through the piston, to react with the resin activator mix in the bore hole. The amount of fluid (second component) pumped into the drill string to flow through the grouting assembly depends upon the amount required to react with the grouting material and force it into the earth formation to be grouted. The ratio of resin to activator depends on the bore hole condition.

An example of a binary formulation is a grouting material which is a premix of a liquid resin sold under the designation "Hydro Active Cut" by De Neef Construction Chemicals Inc. and an accelerator (activator). The premix may be stored in the grouting assembly chamber until needed or poured into the grouting assembly chamber just before being used. Such a grouting material in the presence of water (second component) cures (reacts) to a rigid closed cell polyurethane foam.

The grouting material of a type referred to in the preceding paragraph in the grouting assembly chamber, is kept out of contact with water until ejected into the bore hole and, upon coming into contact with water in the bore hole, or that is discharged through the grouting assembly after the sleeve has at least in part moved inwardly of portions of bores 45, reacts to expand to seal the hole, cracks and fissures in the earth formation even after the drilling operation is continued to drill through the cured grout. Thus the fluid pumped into the drill string to move the piston inwardly may be water.

It is to be understood binary grouting systems other than the one set forth in the preceding two paragraphs, for example, the composition that fills the grouting assembly chamber may be one that cures upon being mixed with a second composition other than water with the second composition being pumped in to move the piston and sleeve inwardly in the assembly chamber, or conventional nonbinary systems, may be used with the tool of this invention.

Even though nozzle portion 34A contains part of the charge of grouting material when the grouting assembly is inserted into the drill string, it is to be understood that portion 34A can be dispensed with while utilizing an inner tube that is longer and is threaded to nozzle part 34 so that the modified assembly (not shown) would contain the same volume of charge as the grouting assembly shown.

What is claimed is:

1. A grouting assembly axially movable in a drill string having a bit end to a position adjacent to the bit end to seat on a drill string landing shoulder, comprising an axially elongated tubular body for containing grouting material, said tubular body having a landing shoulder seatable on the drill string landing shoulder, an inner peripheral wall, an axial outer end and an axial inner end, a nozzle mounted to the tubular body inner end, a head mounted to the outer end of the tubular body and having a fluid passage opening to the outer end of the tubular body, an axial elongated piston mounted in the tubular body for axial movement from an outer position adjacent to the head to an axial inner position adjacent to the nozzle, said piston including an axial outer end portion, an intermediate portion, an outer peripheral wall, a transverse inner end, an inner transverse bore opening through the piston outer peripheral wall and an axial bore opening to the transverse bore and through the piston inner end to the nozzle when the piston is in the inner position of the piston, and sleeve means axially movable relative to the piston and in the tubular body between an axial outer position forming a fluid seal between the piston and the tubular body inner peripheral wall and blocking the transverse bore when the piston is in its outer position and an inner position permitting fluid flow through the transverse port when the piston is in its inner position.

2. The grouting apparatus of claim 1 wherein an overshot coupling device is mounted to the head to extend axially outwardly thereof, at least one of the overshot coupling device and the head having a fluid inlet opening to the head passage.

3. The grouting apparatus of claim 1 wherein the piston outer end portion is of a larger diameter than the piston intermediate portion and the sleeve means inner diameter and of a smaller diameter than the sleeve means outer diameter and an overshot coupling member is mounted to the head to extend outwardly thereof.

4. The grouting apparatus of claim 1 wherein the sleeve means has an inner peripheral wall and the piston outer end portion is of a larger diameter than the inner peripheral wall of the sleeve means to limit the axial outward movement of the sleeve means relative to the piston.

5. The grouting apparatus of claim 4 wherein the transverse bore opens through the piston intermediate portion and the sleeve means is of an axial dimension that is greater than the maximum axial spacing of the opening of the transverse bore through the piston peripheral wall from the piston outer end portion.

6. The grouting apparatus of claim 4 wherein the piston has an inner end portion having the piston transverse inner surface, said inner end portion being of a smaller diameter than the inner diameter of the sleeve means to provide an annular clearance space between the sleeve means and the piston inner end portion when the piston and sleeve means are in their axial inner positions.

7. The grouting apparatus of claim 6 wherein the piston inner end portion has a second transverse bore adjacent to the piston inner end portion that opens through the piston outer peripheral wall to the annular clearance space and that the axial inward movement of both of the piston and sleeve means in the tubular body is limited by abutting against the nozzle.

8. The grouting apparatus of claim 4 wherein the nozzle includes a main body removably attached to the tubular body inner end and having an outlet bore and a nozzle tube having an inner end opening to the outlet bore and an outer end and a first resilient stopper for blocking inward fluid communication from the tubular body to the nozzle tube outer end during axial inward movement of the tubular body in the drill string, said first resilient stopper being of a resiliency for being forced inwardly through the nozzle tube as the piston moves inwardly to force grouting material out of the tubular body.

9. The grouting apparatus of claim 8 wherein a second resilient stopper is mounted to the nozzle tube inner end for being ejected therefrom upon the first resilient stopper being forced inwardly in the nozzle tube, and the tubular body and the nozzle body are of substantially constant inner diameters from the head to nozzle bore.

10. A grouting assembly axially movable in a drill string having a bit end to a position adjacent to the hit end to discharge grouting material into a bore hole, comprising a tubular body having an axial outer end portion and an axial inner end portion, closure means for removably closing the tubular body outer end portion and nozzle means removably mounted to the tubular body inner portion for directing grouting material axially inwardly, the tubular body, closure means and nozzle means cooperatively defining a chamber for containing grouting material, said closure means having an inlet, said nozzle means having a nozzle bore and a discharge end, means mounted in the chamber for axial inward movement under fluid pressure from a first position adjacent to the closure means to a second position adjacent to the nozzle means for forcing grouting material out of the discharge end of the nozzle means, and stopper means mountable in the nozzle bore to block the discharge of grouting material until the forcing means moves inwardly of its first position, the forcing means including a piston movable between the forcing means positions and having a fluid bypass channel and cooperating means for cooperating with the piston to block flow through the bypass channel until the piston has moved to the forcing means second position and thence allow fluid flow through the bypass channel.

11. The grouting apparatus of claim 10 wherein the cooperating means is annular to have the piston extend therein, is axially movable relative to the piston and is of a shorter axial length than the piston and the tubular body has a landing ring shoulder and includes an inner tube having an outer end and an extension tube coupled to the inner tube outer end and to the head.

* * * * *